United States Patent [19]

Gutierrez

[11] Patent Number: 5,055,160

[45] Date of Patent: Oct. 8, 1991

[54] SECURITY PAPER WITH RIGID SEGMENTS

[75] Inventor: Felipe Gutierrez, Madrid, Spain

[73] Assignee: Fabrica Nacional de Moneda Y Timbre, Madrid, Spain

[21] Appl. No.: 615,559

[22] Filed: Nov. 19, 1990

[51] Int. Cl.[5] ..... D21H 21/42

[52] U.S. Cl. ..... 162/103; 162/105; 162/140; 156/265; 156/302; 156/303; 428/211; 428/537.5; 428/916

[58] Field of Search ..... 162/103, 105, 106, 138, 162/140, 256, 268, 322; 156/244.12, 244.25, 244.26, 265, 300, 302, 303; 283/72, 82; 428/211, 230, 537.5, 900, 916

[56] References Cited

U.S. PATENT DOCUMENTS 3,915,780 10/1975 Broussard, Jr. ..... 156/244.12
4,511,616 4/1985 Pitts et al. ..... 428/900
4,761,205 8/1988 Crane ..... 162/140

*Primary Examiner*—Richard V. Fisher
*Assistant Examiner*—Charles K. Friedman
*Attorney, Agent, or Firm*—J. Sanchelima

[57] ABSTRACT

A hybrid band that includes rigid segments into a paper web being formed in a paper manufacturing process. The band includes a carrier that has an adhesive surface for mounting the rigid segments thereon and spacing filler material between contiguous rigid segments for keep them in place. A jacket is formed over the combination that comprises the carrier, segments and filler material. The resulting hybrid band is prestretched prior to its insertion in a paper web being formed in order to compensate for the subsequent shrinkage of the paper web thereby accomplishing the proper and exact positioning of the segments on said paper web.

7 Claims, 5 Drawing Sheets

SECURITY PAPER WITH RIGID SEGMENTS

BACKGROUND OF THE INVENTION

1. Field of the Invention

The present invention relates to a security paper with built-in rigid members, and more particularly, to such security paper that can be readily used in large production paper webs avoiding contact with the knives that cut the web into sheets and smaller portions suitable for the intended end product.

2. Description of the Related Art

A number of techniques have been used to code security paper, such as the paper used for legal tender bills and negotiable instruments in general that carry a nominal value superior to their intrinsic value. Most of these techniques involve the use of water marks and other impressions on the paper that attempt to make it unique in order to frustrate the efforts of wrongdoers that try to duplicate these techniques. The use of a rigid body, preferably with ferromagnetic characteristics, inside the paper creates an unsurmountable burden for these wrongdoers, specially if the rigid segment can be uniquely coded.

The insertion of a rigid body in a paper web faces a number of problems. One of these problems is associated with the marked difference in coefficients or modulus of expansion (elasticity) of the paper being formed and the rigid body being inserted. This is further complicated by the demands imposed by the current production processes of large quantities of security papers such as the one used for printing money bills, stocks, bonds, checks, etc., which require the precise alignment of these rigid segments in relatively large sheets for subsequent cutting and printing operations.

SUMMARY OF THE INVENTION

It is one of the main objects of the present invention to provide a security paper with built-in rigid segments into a web of paper being formed in precise locations.

It is another object of the present invention to provide such a security paper that includes a hybrid band that compensates for the different coefficients or modulus of elasticity inherently characterizing a web of paper under formation and the relative stiffness of a rigid segment being inserted.

It is still another object of this invention to provide such a security paper with built-in hybrid band that includes rigid segments in the paper web that is compatible with the latter without causing it to rupture. The characteristics of the hybrid band are such that it permits the formation of the fibrous paper structure around the band during the manufacture of the paper web without significantly weakening the structure of the resulting paper.

It is yet another object of this invention to provide such a security paper that is inexpensive to implement while retaining its effectiveness.

It is yet another object to select the precise location for the insertion of the rigid members in a continuous production web of paper that avoids the periodic action of the knives that are conventionally used to cut a web into more manageable sheets and eventually cut to a size that is compatible with the purposes of the end product sought.

Still another object of this invention is to provide such a hybrid band that has a sufficiently high modulus of elasticity that permits its insertion during the manufacture of the paper web and the band withstands the characteristic expansion stresses suffered typically by those webs under formation without causing it to rupture or wrinkle and isolating said stress from the rigid segments it contains.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
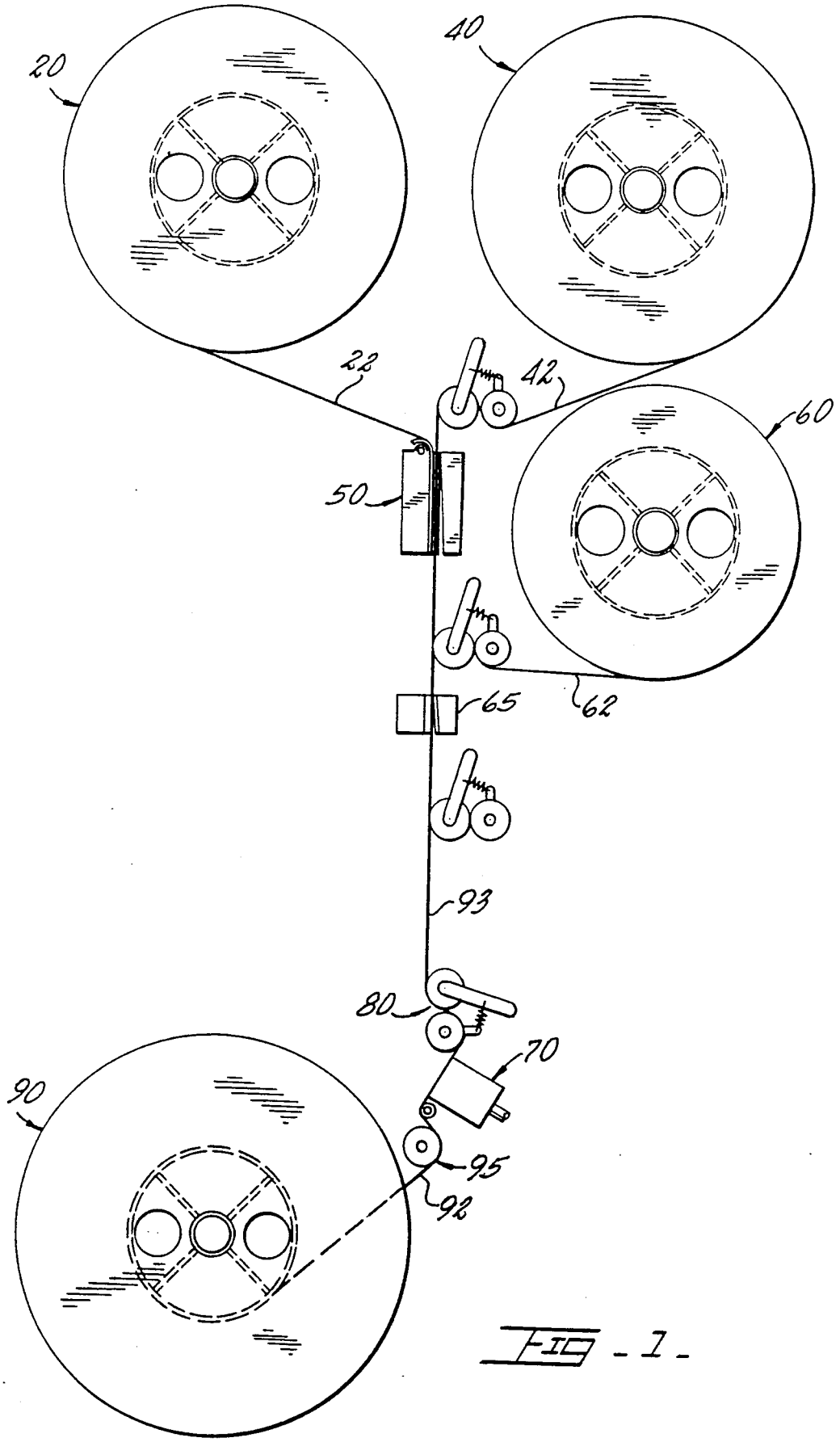
FIG. 1 represents the machinery used in the process of manufacturing the hybrid band required for its subsequent insertion in the paper web.

Referring now to FIG. 1, a continuous adhesive carrier strip or tape 22 is supplied by adhesive carrier supply reel 20 wherein the rigid segements 94 will be placed. The segments are cut from a continuous rigid wire material 42 wound in a supply reel 40 that feeds it to a stepping device 50 for cutting and positioning the resulting rigid segments 94 on the adhesive carrier tape 22. The advance sequence of the rigid wire material 42 in stepping device 50 and the motion of the core drive mechanism 80 are controlled so that the dimensions of the resultant core are precisely controlled. For the purposes of this application the core consists of the assembly comprising the adhesive carrier tape 22 with a rigid segment 94 correctly positioned on it and the filler member 62 between contiguous rigid segments 94 as described below.

A third supply reel 60 feeds an elastic filler member 62 to a filler punch 65 that cuts and deposits segments of filler member 62 in the spaces between the rigid segments 94. The thickness of the filler member determines the thickness of the hybrid band in the spaces between the segments. If no filler is deposited between the segments, the spaces between the segments of the hybrid band 92 will have the minimum possible thickness. It is possible to have a uniform thickness or to control the thickness of the filler in order to make these spaces detectable even by the human touch. This is particularly useful for blind persons ascertaining the value of the document tendered to them. Therefore, it is possible to control (or modulate) in which spaces the thickness will be uniform with the contiguous thickness of the segments and which spaces will be the minimum (no filler member). This modulation can be encoded to convey information or the paper where the band is affixed.

Figure 4A:
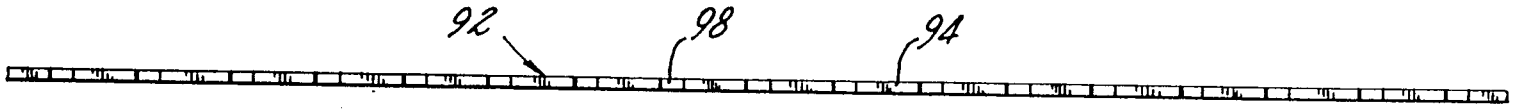
FIG. 4*a* is an enlarged top view of the hybrid band with the elastic jacket.
Figure 4B:
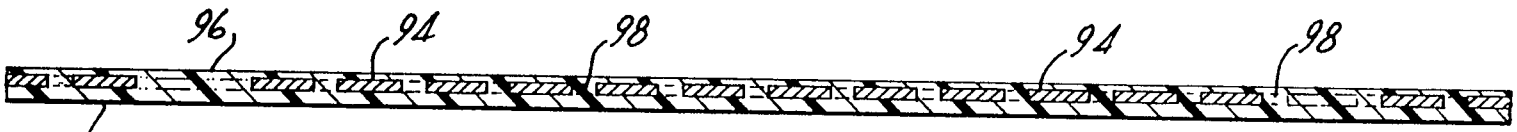
FIG. 4*b* shows side view of the hybrid band shown in FIG. 4*a* wherein the vertical dimensions has been enlarged.
Figure 4C:
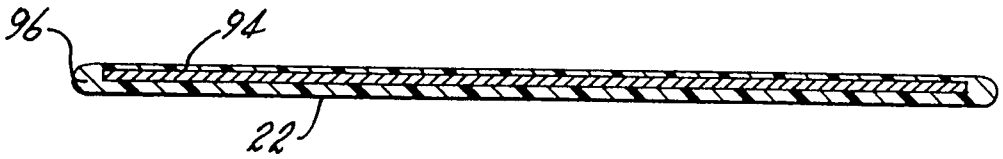
FIG. 4*c* is a cross-sectional end view of the hybrid band represented in FIGS. 4*a* and 4*b* further enlarged.

Once the core 93 has been assembled with the rigid segements 94 and filler member 62 placed on the adhesive carrier tape 22, it is fed into extrusion crosshead 70 in which an elastic jacket 96 is formed completely surrounding the core, as best seen in FIGS. 4*a*; 4*b* and 4*c*. The resultant hybrid band 92 is collected in a suitable take-up reel 90. Extruder take up mechanism 95 pulls the extruded hybrid band 92 from crosshead extruder 70. In the preferred embodiment, adhesive carrier tape 22, filler member 62 and jacket 96 are all made out of the same elastic material and it has been determined that polyester is a suitable material.

Figure 2:
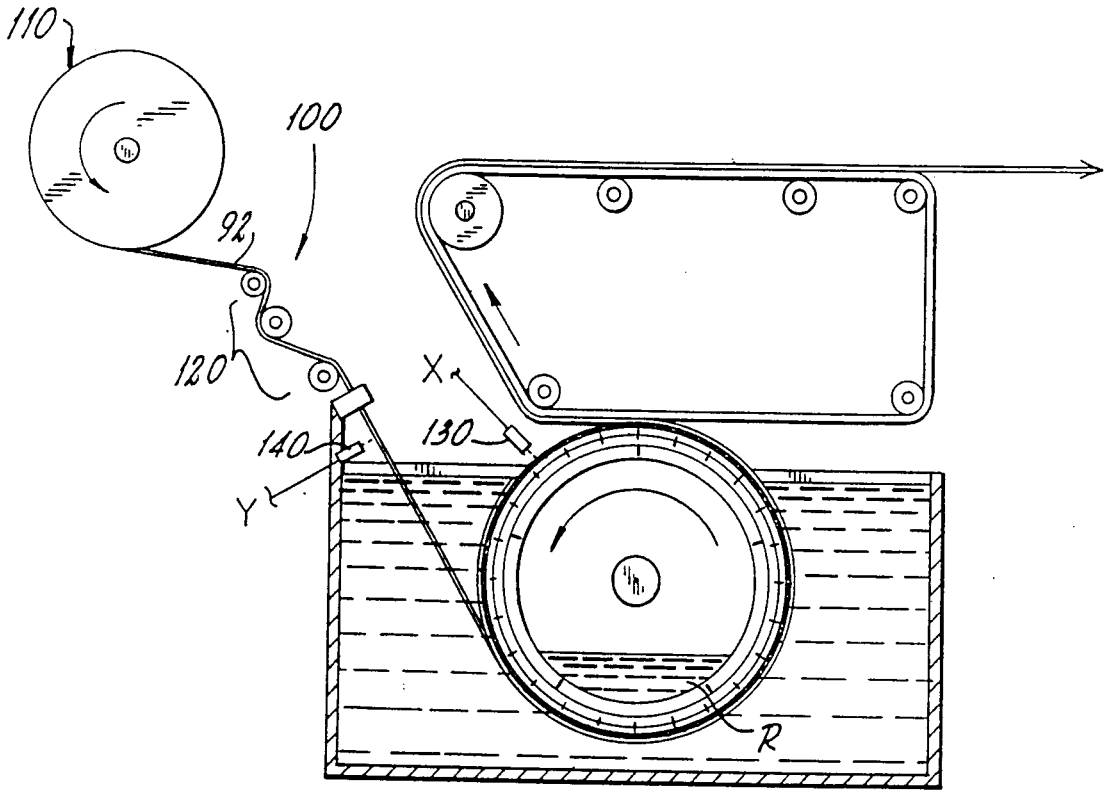
FIG. 2 illustrates the initial stage of a conventional paper manufacturing process including the mechanism that facilitates the insertion process of the hybrid band referred to in FIG. 1.

After the hybrid band has been manufactured, it is placed in insertion mechanism 100 shown in FIG. 2 where the initial stage of a conventional process for manufacturing paper is shown. Hybrid band supply reel 110 feeds hybrid band 92 into band tensioning device 120. Band tensioning device 120 pre-stretches hybrid band 92 as it is fed into paper forming screen roll R. The tension applied to the band results in a stretching of hybrid band 92. By controlling the tension applied to the hybrid band at this point, the positioning of the segments relative to the sheets of paper being formed on the screen roll can be adjusted. Sensors 130 and 140 which accurately measure the position of the screen roll R and hybrid band segments 94 are placed at appropriate locations as illustrated in FIG. 2.

Figure 3:
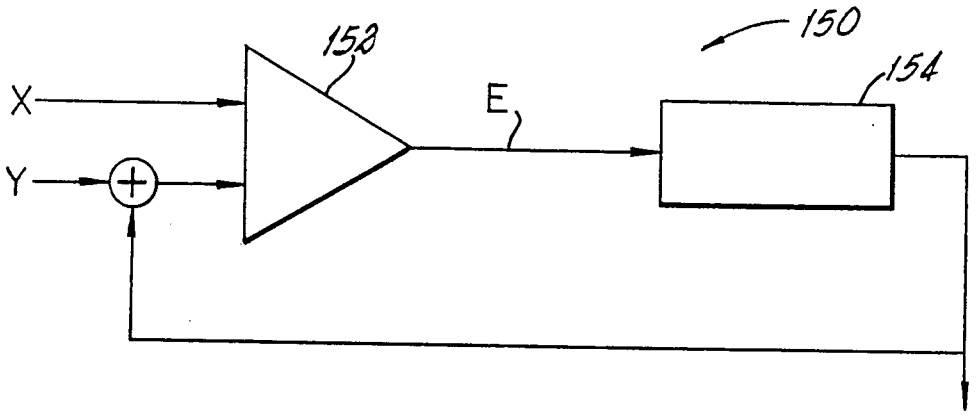
FIG. 3 is a block diagram of the servo control circuitry used to obtain the correct positioning of the hybrid band on the paper web being formed.

FIG. 3 is a block diagram of the servo control circuit 150 required to assure the correct positioning between the paper web and the hybrid band segments 94. This circuit 150 uses the signals X and Y from the position sensors of the screen-roll 130 and hybrid band segments 140 to develop an error signal E which, after suitable processing by differential amplifier circuit 152 and low pass filter and amplifier 154, is used to control the tension applied to the hybrid band by the band tensioning device 120. The resulting signal Z is sent to device 120. This maintains a correct position of the segments 94 of the hybrid band relative to the sheets of paper being continuously produced.

The error signal E produced by the control system will be positive or negative according to the direction of the misalignment detected by sensors 130 and 140. Since hybrid band 92 does not admit compressive efforts, a tensile strain bias is applied to hybrid band 92 such that when the error signal E is zero, a preset tension determined by the bias is applied to hybrid band 92. The corresponding bias strain is considered when dimensioning the spacing of segments 94 of the hybrid band core 93. The inventor's experience has been that a pre-tensioning strain between 1.0% and 2.0% of length of the hybrid band has provided satisfactory results.

Figure 5:
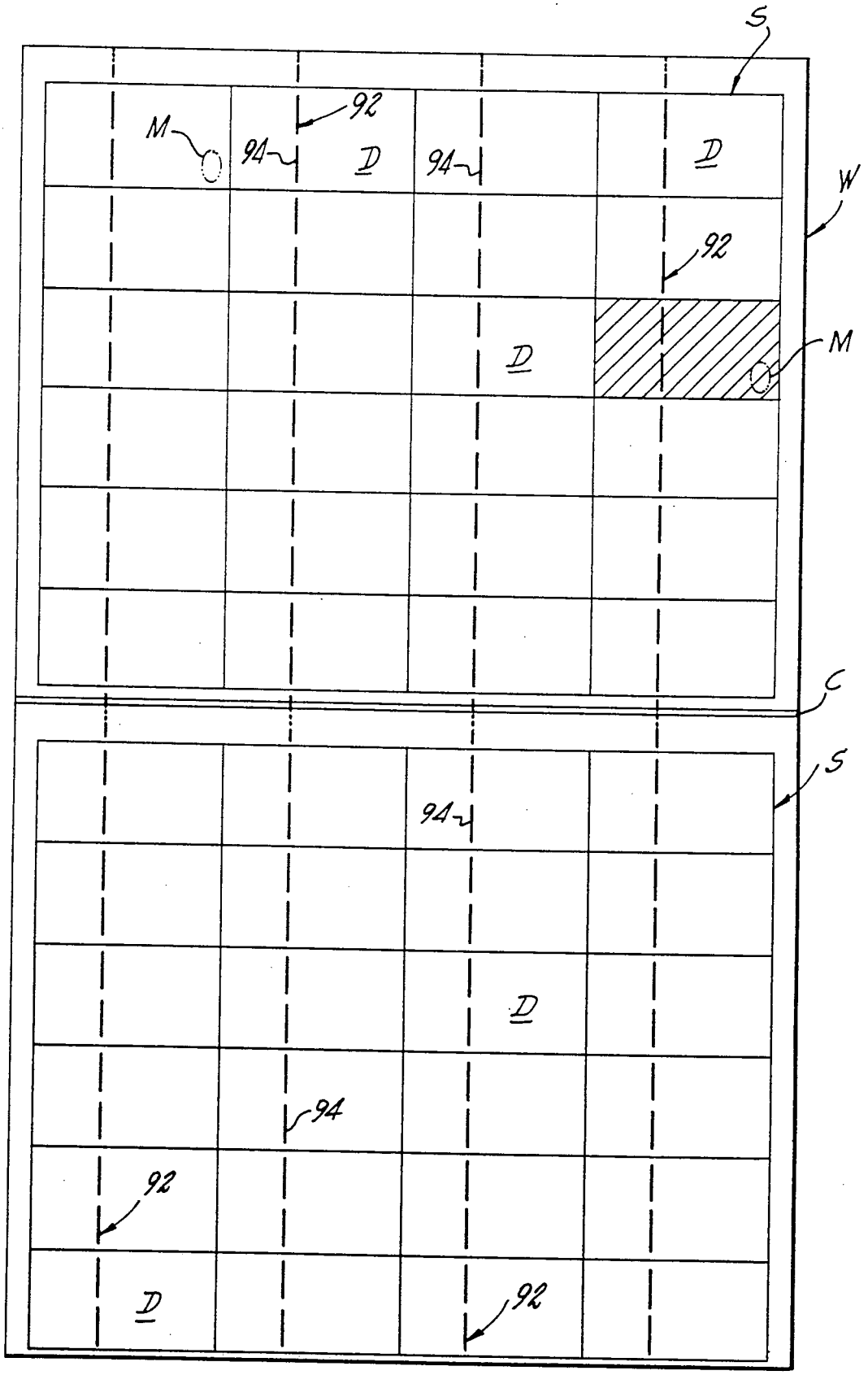
FIG. 5 is a top view of a section of the paper web that results from the process.

The resulting paper web W is shown partially in FIG. 5 where the position of segments 94 of the hybrid band are represented. Sheets S are subsequently cut containing a predetermined number of documents D for subsequent printing and cutting. In the preferred embodiment shown in FIG. 5, it can be observed that four hybrid bands 92 have been formed on web W and the process needs to be synchronized so that the relative positions of the rigid segments 94 of each hybrid bank 92 are kept at substantially the same position relative to the paper web.

In the preferred embodiment, rigid segments 94 have one inch in length, 0.02 inches in width and 0.002 inches thick. The separation between rigid segments 94 is 0.5 inches. Each hybrid band 92 has 12 rigid segments 94 and one hybrid band 92 fits on each sheet to be cut longitudinally. In FIG. 5, four hybrid bands have been positioned across that run parallel to each other. Each sheet S to result from transversally cutting web W at predetermined intervals will fit one hybrid band 92 along its length and as many across as desired. Since at least one of such bands has to pass through the resulting document D, the number of bands across will be determined by the intended dimensions for said documents D. As it can be seen from FIG. 5, there are two rigid segments 94 inside each document D. It is also possible to affix water marks M in the manner already being conventionally done without interfering with bands 92. Between two contiguous bands 92 there is a line C where web W is cut with transversal knives and the distance between the two contiguous bands 92 corresponds to the length of one rigid segment 94 plus two 0.5 inches for each end of the rigid segment 94, totaling 2.0 inches. No rigid members are mounted at the position of the 13th rigid segment 94 in order to prevent any interference with the knives.

Figure 6A:
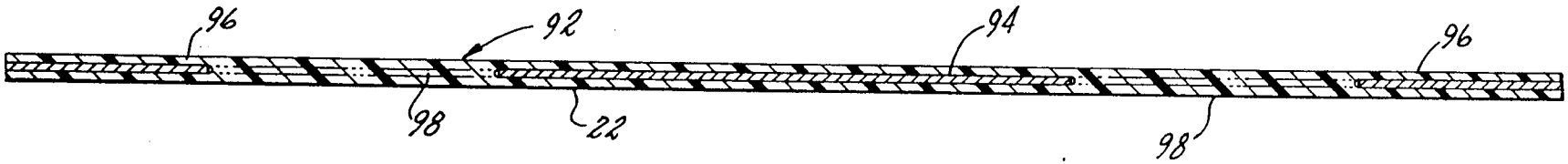
FIG. 6A represents an enlarged cross-sectional end view of a portion of the hybrid band where the horizontal and vertical direction have been enlarged.
Figure 6B:
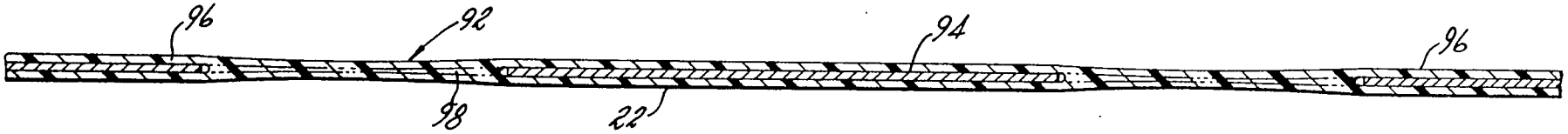
FIG. 6B shows the portion shown in FIG. 5A in this pre-stretched mode.

In FIGS. 6A and 6B, it can be observed how band 92 can be stretched to accommodate the longitudinal expansion of the paper W. The elastic jacket is stretched out proportionally and the rigid segments 94 keep their relative position. In fact, it is like having the rigid segments 94 almost floating inside the elastic jacket.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A hybrid band inserted into water laid paper webs during fabrication, comprising:

A. elastic band carrier means including an adhesive surface;

B. a plurality of rigid segments continuously mounted on said adhesive surface at a predetermined spaced apart relationship between each other;

C. a corresponding plurality of elastic filler means for separating said rigid segments are mounted to said band carrier means and in between said rigid segments thereby keeping said rigid members in a paced apart relationship to each other;

D. elastic jacket means for covering said band carrier means, rigid segments and filler members and said resulting hybrid band having suitable combined elastic properties to stretch with the expansion of said paper webs.

2. The hybrid band set forth in claim 1 wherein said elastic band carries means, jacket means and filler means are made out of polyester.

3. The hybrid band set forth in claim 1 wherein said jacket means is formed in said hybrid band through an extrusion process.

4. The hybrid band set forth in claim 3 wherein the mounting of said elastic filler means is selectively regulated thereby encoding information.

5. The hybrid band set forth in claim 2 wherein said rigid members are made out of a ferro magnetic material.

6. The hybrid band set forth in claim 5 wherein elastic band carrier means, said filler means and jacket means are made out of polyester.

7. The hybrid band set forth in claim 5 wherein the mounting of said elastic filler means is selectively regulated thereby encoding information.

* * * * *